United States Patent [19]

Schreiber

[11] 3,978,821

[45] Sept. 7, 1976

[54] ENERGY PRODUCER USING DUAL FUELS

[76] Inventor: Edward T. Schreiber, 7400 Lyndale Ave. South, Minneapolis, Minn. 55423

[22] Filed: May 9, 1975

[21] Appl. No.: 576,201

[52] U.S. Cl. ..... 122/5; 423/658; 48/197 R

[51] Int. Cl.[2] ..... F22B 1/00

[58] Field of Search ..... 122/5, 7 R, 7 B; 48/197 R; 423/579, 658

[56] References Cited

UNITED STATES PATENTS

| | | | |
|---|---|---|---|
| 1,403,189 | 1/1922 | Palmer | 423/658 |
| 2,097,463 | 11/1937 | Magee | 122/7 X |
| 2,182,747 | 12/1939 | Marshall, Jr. | 423/658 |
| 3,001,513 | 9/1961 | Wolf et al. | 122/7 |
| 3,222,147 | 12/1965 | Benson | 48/197 |

*Primary Examiner*—Kenneth W. Sprague
*Attorney, Agent, or Firm*—Clarence A. O'Brien; Harvey B. Jacobson

[57] ABSTRACT

A gas generator is provided in the form of a closed housing having a predetermined amount of iron filings disposed therein and including a fluid inlet and a fluid outlet. A steam generator is also provided for heating water into steam and the steam generator includes an outlet communicated with the inlet of the gas generator housing. The steam and gas generators are operatively associated with a furnace with the steam generator being operatively associated with the combustion gas outlet of the furnace and the gas generator housing disposed within the combustion chamber of the furnace. The gas generator housing is shielded against direct exposure to the air and fuel mixture burning in the furnace and the furnace includes not only air and primary fuel inlets for the admission of air and fuel into the combustion chamber and mixing in the latter, but the combustion chamber additionally includes a supplemental fuel inlet to which the outlet of the gas generator housing is communicated. By producing steam within the steam generator and ducting the steam from the steam generator through the gas generator in a manner to pass the heated steam through the iron filings within the gas generator in intimate contact therewith the gas generator functions as a catalytic converter to convert at least a major portion of the steam passing through the gas generator housing into its oxygen and hydrogen components. The oxygen and hydrogen gases are then ducted to the combustion chamber supplemental fuel inlet whereby the hydrogen and oxygen gases are burned in the combustion chamber as a supplemental fuel.

7 Claims, 3 Drawing Figures

ENERGY PRODUCER USING DUAL FUELS

BACKGROUND OF THE INVENTION

Various structures have been heretofore designed for converting steam into its hydrogen and oxygen gas components. However, these previous structures have not been specifically related to a furnace utilizing a supply of air and a primary fuel for forming a combustible mixture in the combustion chamber of the furnace and with the hydrogen and oxygen gases produced from steam utilized as supplemental fuels for the furnace.

SUMMARY OF THE INVENTION

The energy producer of the instant invention utilizes the heat of combustion of a mixture of air and a primary fuel for producing steam in a steam boiler installation and the heat of the exhaust gases from the combustion chamber operatively associated with the steam boiler is utilized to convert a further supply of water into steam. This latter steam is directed through a closed housing having iron filings disposed therein and positioned to absorb considerable quantities of heat from the combustion chamber of the steam boiler. By passing the last mentioned steam over the heated iron filings, the steam is converted into its oxygen and hydrogen gas components by catalytic action and these gases are thereafter ducted to the combustion chamber of the steam boiler for burning as a supplemental fuel. The temperature of the hydrogen and oxygen gas producer is controlled so as to prevent the hydrogen and oxygen gases from being heated in excess of their ignition temperatures before the hydrogen and oxygen gases are admitted into the combustion chamber as supplemental fuels.

The main object of this invention is to provide a means whereby a considerable quantity of supplemental fuel may be generated through the utilization of relatively inexpensive and readily available supplies of water and iron filings.

Another object of this invention, in accordance with the immediately preceding object, is to provide a steam generator for converting the supply of water into steam and which will be capable of utilizing the heat of waste exhaust gases of the furnace portion of a steam boiler for the purpose of converting the water into steam.

A further object of this invention is to provide a catalytic converter of the closed housing type through which generated steam may be passed in intimate contact with iron filings disposed within the housing and with the housing in operative association with the combustion chamber of the furnace of a steam boiler in a manner such that the iron filings will be sufficiently heated by the heat of combustion within the combustion chamber in order to transform the steam passing through the housing in intimate contact with the heated iron filings into its hydrogen and oxygen gas components by catalytic action.

Another important object of this invention is to provide an energy producer utilizing dual fuels including a primary fuel and supplemental fuels and with the supplemental fuels being generated by the energy producer itself through the utilization of relatively inexpensive materials.

A final object of this invention to be specifically enumerated herein is to provide an energy producer in accordance with the preceding objects and which will conform to conventional forms of manufacture, be of simple construction and easy to operate so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
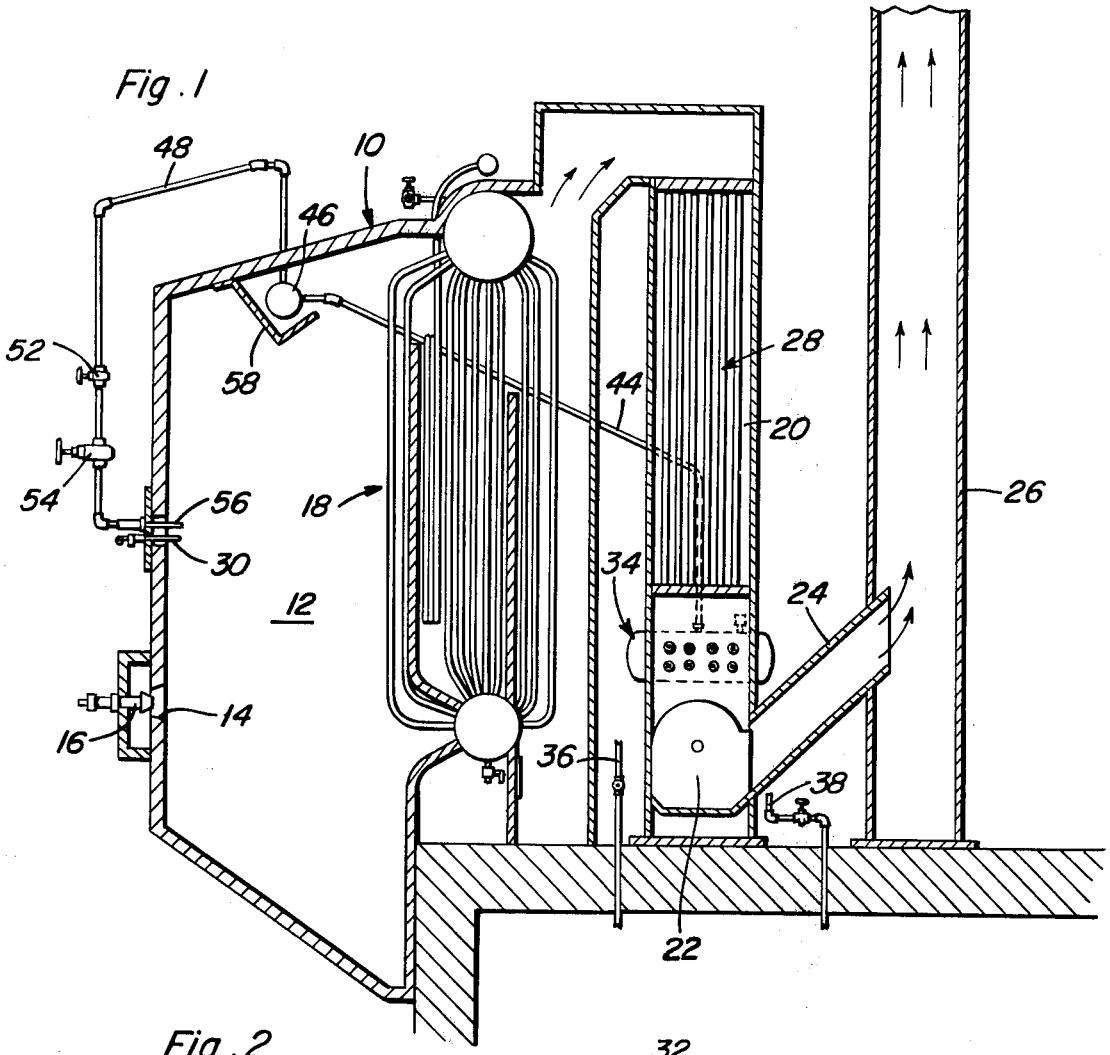
FIG. 1 is a vertical sectional view taken substantially upon a plane passing through a conventional form of steam boiler construction and with the supplemental fuel producing apparatus of the instant invention operatively associated therewith.

Referring now more specifically to the drawings, the numeral 10 generally designates a furnace including a steam boiler of conventional design having a combustion chamber or firebox 12 into which combustion air is admitted through an inlet 14 and a liquid fuel such as oil is injected from a nozzle 16 to which liquid fuel is supplied in any convenient manner (not shown). A conventional tube type boiler referred to in general by the reference numeral 18 is disposed within the combustion chamber for generating steam therein, a suitable supply of water being provided for the boiler 18 through conventional controls (not shown). The combustion chamber 18 includes a combustion gas exhaust passage 20 with which a blower 22 is operatively associated for drawing combustion gases from the combustion chamber 12 and discharging the combustion gases through an outlet 24 into the lower end of an upwardly opening stack 26. The exhaust passage 20 may include a conventional economizer referred to in general by the reference numeral 28 and an igniter 30 is provided in the combustion chamber 12 for igniting the mixture of air and primary liquid fuel within the chamber 12.

The foregoing comprises a description of the structure and operation of a conventional steam boiler.

Figure 2:
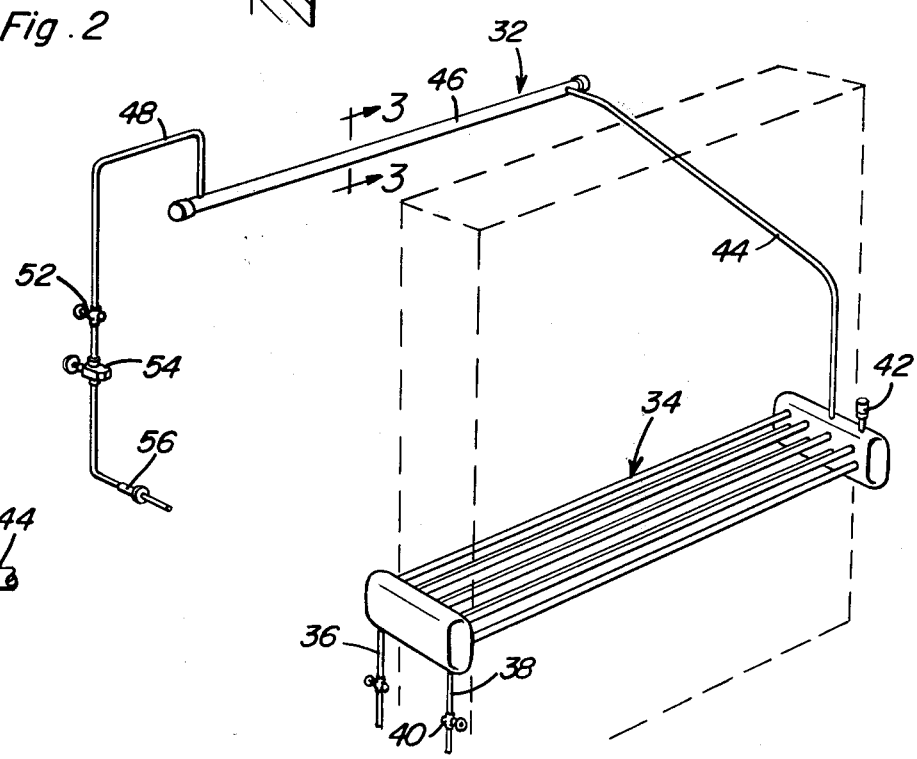
FIG. 2 is a perspective view of the supplemental fuel producing structure.

Referring now more specifically to FIGS. 1 and 2, the instant invention is referred to in general by the reference numeral 32 and includes a tube type boiler/vaporizer referred to in general by the reference numeral 34 disposed within the exhaust passage 20 downstream from the economizer 28. The boiler/vaporizer includes a valved drain line 36 and a feed water line 38 equipped with a valve 40 which may be under the control of various actuating controls (not shown). Further, the boiler-vaporizer includes an excess pressure relief valve 42.

A steam discharge line 44 extends from the boiler-vaporizer to the inlet of a closed gas generator housing 46. The line 44 opens into one end of the housing 46 and the latter is equipped with a discharge line 48 opening outwardly of its other end.

Figure 3:
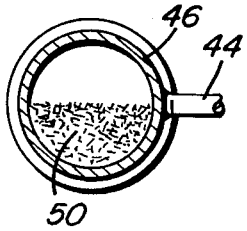
FIG. 3 is an enlarged fragmentary vertical sectional view taken substantially upon the plane indicated by the section line 3—3 of FIG. 2.

From FIG. 3 of the drawings it may be seen that the housing 46 has a quantity of iron filings 50 disposed therein and in FIG. 2 it may be seen that the discharge line 48 is equipped with a manual shut-off valve 52 as well as an automatic control valve 54 whose operation may be under the control of various operating controls (not shown). The discharge end of the line 48 opens into the combustion chamber 12 as at 56 and it may be seen from FIG. 1 of the drawings that the housing 46 is shielded from direct exposure to the flames of combustion within the combustion chamber 12 by means of a shield 58.

In operation, the steam boiler 10 is operative in the conventional manner whereby a mixture of liquid fuel and air is ignited by the igniter 30 within the combustion chamber 12 in order to generate steam within the tube boiler 18. However, steam generated within the boiler-vaporizer 34 is discharged therefrom through the line 44 and into the inlet end of the housing 46 whereupon the steam is heated to a greater extent and passes through the housing 46 in intimate contact with the heated iron filings 50 within the housing 46. As the steam passes through the housing 46 in contact with the iron filings 50 the steam, to a great degree, is broken down into its hydrogen and oxygen gas components by catalytic action and the hydrogen and oxygen gases are ducted through the line 48 and discharged into the combustion chamber 12 as supplemental fuels. Accordingly, through the utilization of relatively inexpensive iron filings and water as well as the heat of exhaust gases being pumped into the stack 26 supplemental fuel gases are generated to the extent that considerable savings in fuel costs may be realized.

The shield 58 is provided so as to prevent the hydrogen and oxygen gases being generated within the housing 46 from being heated to temperatures in excess of 700°, this temperature being approximately 200°F. below the ignition temperatures of the supplemental fuel gases being generated. Further, the automatic control valve 54 may include an actuator in the form of a temperature sensor operative to sense the temperature of gases within the housing 46 whereby the free discharge of gases from the housing 46 will be permitted in the event the temperature of the gases within the housing 46 increases to a level approaching 700°F. By allowing a free discharge of gases from the housing 46 the flow of steam therethrough is accelerated and the temperature of the supplemental fuel gases being generated is lowered.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a combustion chamber into which air and a primary fuel are admitted for continuous burning, an exhaust outlet for said chamber whereby exhaust gases may be vented from said chamber, supplemental fuel inlet means for said combustion chamber, steam generator means having a steam outlet, a gas generator including a housing having a predetermined amount of iron filings disposed therein and fluid inlet and fluid outlet means, means connecting said steam outlet with said fluid inlet means, means communicating said fluid outlet means with said supplemental fuel inlet means, said gas generator housing being closed and disposed within said combustion chamber for heating of said housing, the iron filings therein and the steam discharged into said housing from said steam generator, said steam generator being disposed in good heat transfer relation with at least some of the exhaust gases passing through said exhaust outlet, the steam generated in said steam generator being discharged into said gas generator housing and converted, at least to a great extent, into its hydrogen and oxygen gas components by catalytic action upon being further heated in said housing and passing through the latter in intimate contact with the heated iron filings in said housing with the hydrogen and oxygen gases produced in said gas generator then being admitted into said combustion chamber as supplemental fuels through said supplemental fuel inlet means.

2. The combination of claim 1 including heat shield means in said combustion chamber operative to shield said housing from direct exposure to the heat of combustion in said chamber, whereby to prevent the hydrogen and oxygen gases being generated in said housing from being heated in excess of their ignition temperatures.

3. The combination of claim 1 including a furnace having a firebox, said combustion chamber comprising the firebox of said furnace.

4. The combination of claim 3 including a steam boiler having a heating component, said furnace comprising the heating component of said steam boiler.

5. The combustion of claim 4 wherein said steam boiler includes a pre-heater for water, said pre-heater being disposed in said exhaust outlet upstream from said steam generator.

6. The combination of claim 5 including heat shield means in said combustion chamber operative to shield said housing from direct exposure to the heat of combustion in said chamber, whereby to prevent the hydrogen and oxygen gases being generated in said housing from being heated in excess of their ignition temperatures.

7. The combination of claim 1 wherein said steam generator comprises a tube-type heat exchanger disposed in said exhaust outlet and includes means operative to admit water to be heated thereinto.

* * * * *